US011305170B2

(12) United States Patent
Destro

(10) Patent No.: US 11,305,170 B2
(45) Date of Patent: Apr. 19, 2022

(54) TETHERED RESISTANCE SWIM TRAINING APPARATUS

(71) Applicant: Destro Machines LLC, Pittsburgh, PA (US)

(72) Inventor: Charles Destro, Verona, PA (US)

(73) Assignee: Destro Machines LLC, Pittsburgh, PA (US)

( * ) Notice: Subject to any disclaimer, the term of this patent is extended or adjusted under 35 U.S.C. 154(b) by 0 days.

(21) Appl. No.: 16/872,786

(22) Filed: May 12, 2020

(65) Prior Publication Data

US 2020/0376357 A1 Dec. 3, 2020

Related U.S. Application Data

(60) Provisional application No. 62/853,207, filed on May 28, 2019.

(51) Int. Cl.

| | |
|---|---|
| ***A63B 69/12*** | (2006.01) |
| ***A63B 21/008*** | (2006.01) |
| ***A63B 21/00*** | (2006.01) |
| *A63B 21/06* | (2006.01) |
| *A63B 21/16* | (2006.01) |

(52) U.S. Cl.

CPC ..... *A63B 69/12* (2013.01); *A63B 21/0084* (2013.01); *A63B 21/154* (2013.01); *A63B 21/0602* (2013.01); *A63B 21/169* (2015.10); *A63B 21/4001* (2015.10); *A63B 2225/60* (2013.01); *A63B 2244/20* (2013.01)

(58) Field of Classification Search

CPC ..... A63B 21/0084; A63B 21/0602; A63B 21/154; A63B 21/169; A63B 21/4001; A63B 21/00058; A63B 21/06; A63B 21/0604; A63B 21/0603; A63B 21/0605; A63B 21/0606; A63B 21/0607; A63B 21/0608; A63B 21/0609; A63B 21/0615; A63B 21/0616; A63B 21/0617; A63B 21/0618; A63B 21/062; A63B 21/0622; A63B 21/0624; A63B 21/0626; A63B 21/0628; A63B 69/12; A63B 2225/60; A63B 2244/20; A63B 2208/03

See application file for complete search history.

(56) References Cited

U.S. PATENT DOCUMENTS

| | | | | |
|---|---|---|---|---|
| 3,861,675 A * | 1/1975 | Hopper | A63B 69/12 482/55 |
| 8,388,502 B2 * | 3/2013 | Tedhams | A63B 69/12 482/54 |
| 9,265,990 B2 * | 2/2016 | Reese | A63B 35/00 |
| 9,604,088 B2 * | 3/2017 | Djang | A63B 21/065 |
| 2021/0146215 A1 * | 5/2021 | Destro | A63B 21/4001 |

* cited by examiner

*Primary Examiner* — Megan Anderson
(74) *Attorney, Agent, or Firm* — Keevican Weiss & Bauerle LLC; Jeffrey D. Mulrooney

(57) ABSTRACT

An aquatic exercise apparatus for applying a resistive force to an exercising swimmer, the apparatus includes a bracket mounted to a vertically oriented surface located above a pool of water, a container, an operational assembly comprising at least one upper pulley attached to the bracket and at least one lower pulley attached to the container, a cord passing through the at least one upper pulley and the at least one lower pulley, and a fastener configured to attach to an exercising swimmer, where the fastener is attached to a free end of the cord, and where pulling the free end of the cord moves the container upward against gravity.

7 Claims, 6 Drawing Sheets

TETHERED RESISTANCE SWIM TRAINING APPARATUS

CROSS-REFERENCE TO RELATED APPLICATION

This application is based on and claims priority to U.S. Provisional Patent Application No. 62/853,207 filed May 28, 2019 entitled "TETHERED RESISTANCE SWIM TRAINING APPARATUS".

BACKGROUND

The present invention relates to an aquatic exercise system and more particularly pertains to applying a resistive force to an exercising swimmer, for extending such resistive force to a number of swimmers, and for varying the number of swimmers to experience such resistive force. Prior devices including U.S. Pat. No. 3,861,675 to Hopper, U.S. Pat. No. 9,265,990 to Reese et al., and U.S. Pat. No. 9,604,088 to Djang have endeavored to provide such a system and those disclosures are herein incorporated by reference.

Prior art systems and devices in the field of tethered resistance swim training often require a tower of substantial height to hold and guide a weight (e.g. a bucket filled with water) that is being pulled by a swimmer in a pool of water. This arrangement requires that the tower and cables be designed in such a way that to prevent the tower from tipping over due to the forces applied to it. Additionally, due to the corrosive environment (outdoors or inside with a chlorinated pool) these devices are used in the materials used for construction are preferably corrosion resistant. Since the materials should also be strong, this leaves more expensive materials, such as stainless steel to be used in the large tower. An object of the present invention is to eliminate or at least mitigate the above shortcomings in the art.

SUMMARY

The present invention in at least one embodiment is a tethered resistance swim training apparatus that replaces the prior art tower with a mounted bracket thus reducing the material costs by using much less structural material. This arrangement also allows for a greater range of configurations (larger range of height options; and less limiting on the number of pulleys that can be used). In at least one embodiment the bracket includes a gusset plate with an elongated hole for attaching elastic cords for additional resistance options.

The present invention in another embodiment is an aquatic exercise apparatus for applying a resistive force to an exercising swimmer, the apparatus comprising a bracket mounted to a vertically oriented surface located above a pool of water, a container, an operational assembly comprising at least one upper pulley attached to the bracket and at least one lower pulley attached to the container, a cord passing through the at least one upper pulley and the at least one lower pulley, and a fastener configured to attach to an animal, wherein the fastener is attached to a free end of the cord, and wherein pulling the free end of the cord moves the container upward against gravity. In yet another embodiment the bracket is L-shaped. In still another embodiment the apparatus includes a plate attached to the bracket, where the plate defines an elongated opening configured to receive at least one elastic cord that is attached to the fastener. In yet still another embodiment the bracket is L-shaped, and is mounted to the vertically oriented surface via an adjustable clamping mechanism. In yet another embodiment the bracket defines a circular opening at a distal end of the bracket, said circular opening being configured to receive a pullup bar.

The present invention in another alternative embodiment is an aquatic exercise apparatus for applying a resistive force to an exercising swimmer, the apparatus comprising an L-shaped bracket mounted to an object located above a pool of water, a container configured to hold a liquid substance or a solid substance, an operational assembly comprising at least one upper pulley attached to the bracket and at least one lower pulley attached to the container, a cord passing through the at least one upper pulley and the at least one lower pulley, and a fastener configured to attach to an animal, where the fastener is attached to a free end of the cord; and where pulling the free end of the cord moves the container upward against gravity. In still another embodiment the bracket is mounted to the object via an adjustable clamping mechanism. In still yet another embodiment the bracket defines a circular opening at a distal end of the bracket, said circular opening being configured to receive a pullup bar.

DETAILED DESCRIPTION OF THE INVENTION

Figure 1:
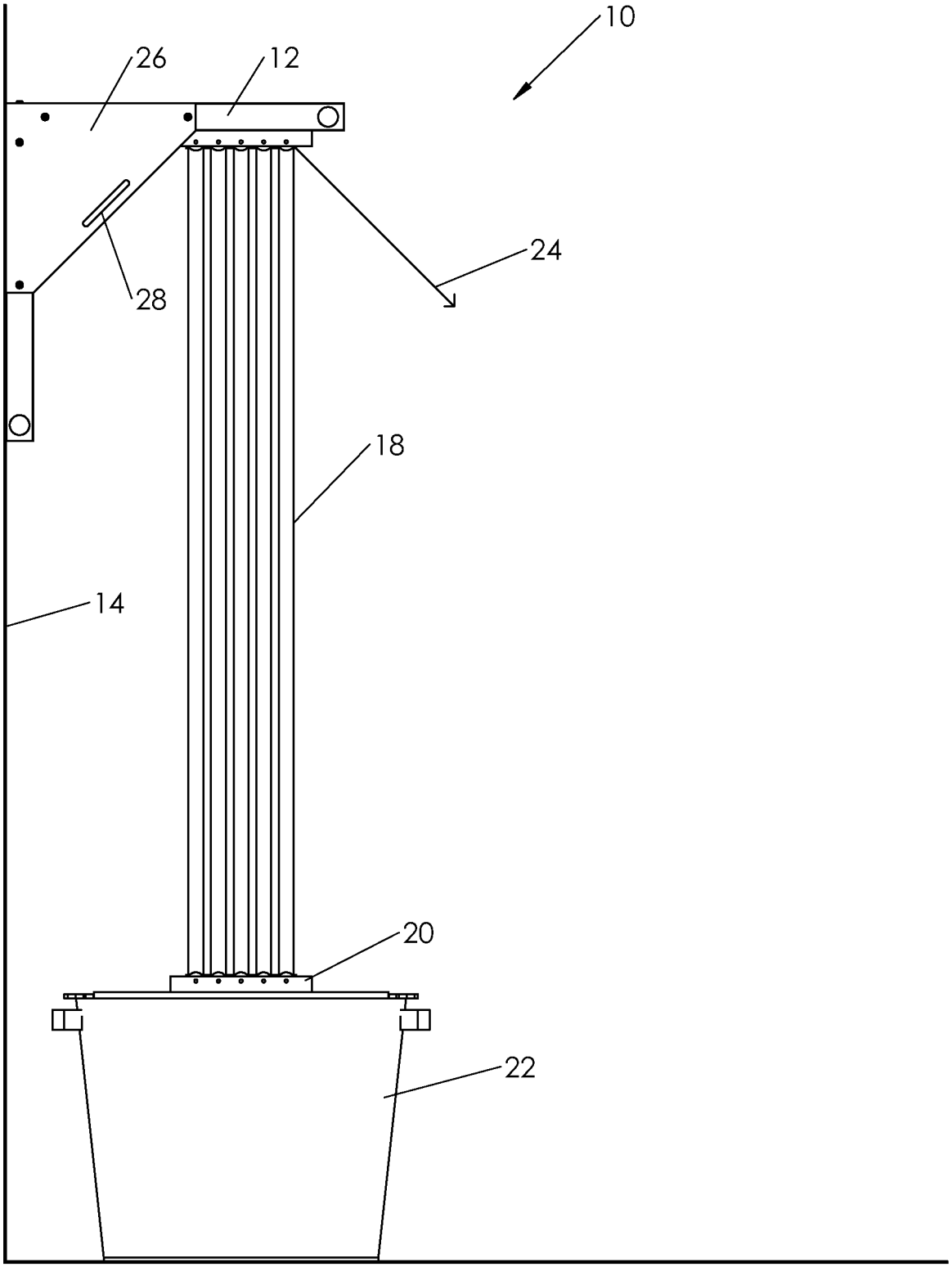
FIG. 1 is an overall side view of an embodiment of the tethered resistance swim training apparatus.
Figure 2:
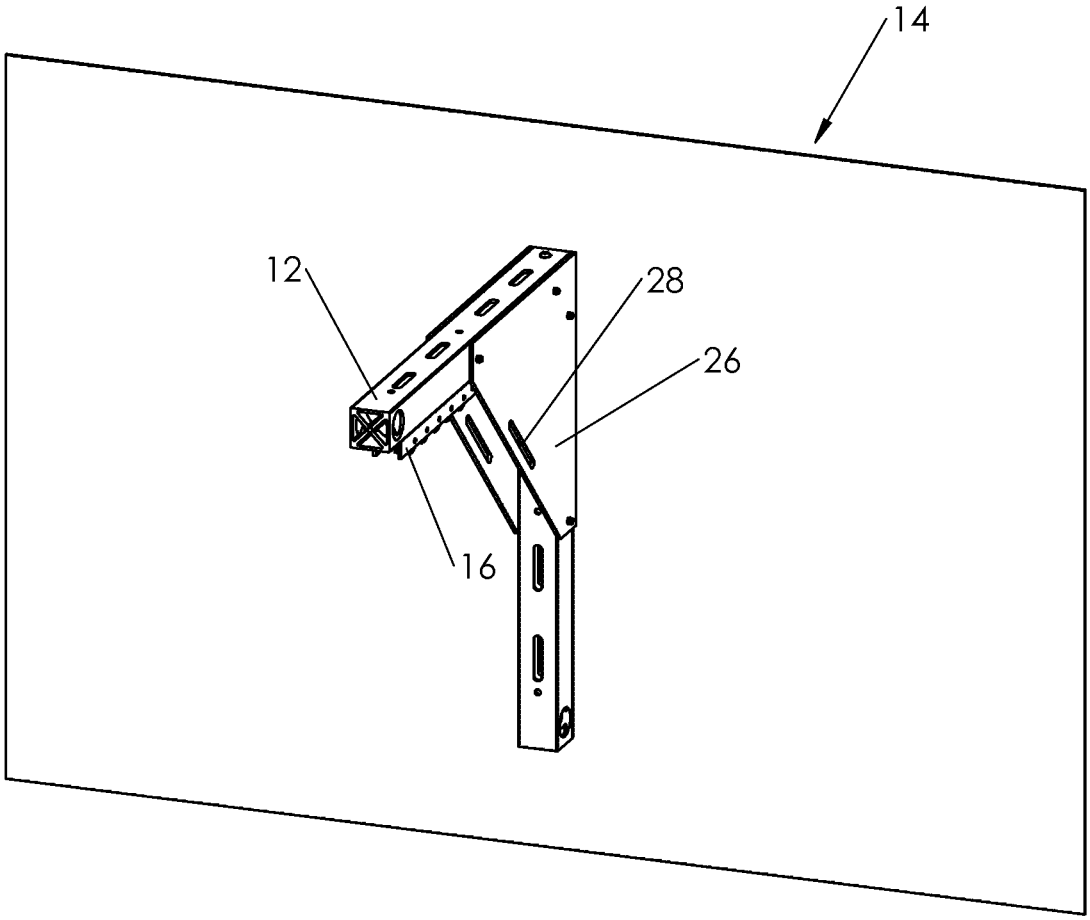
FIG. 2 is an isometric view of an embodiment of the bracket of the tethered resistance swim training apparatus attached to a wall.
Figure 3:
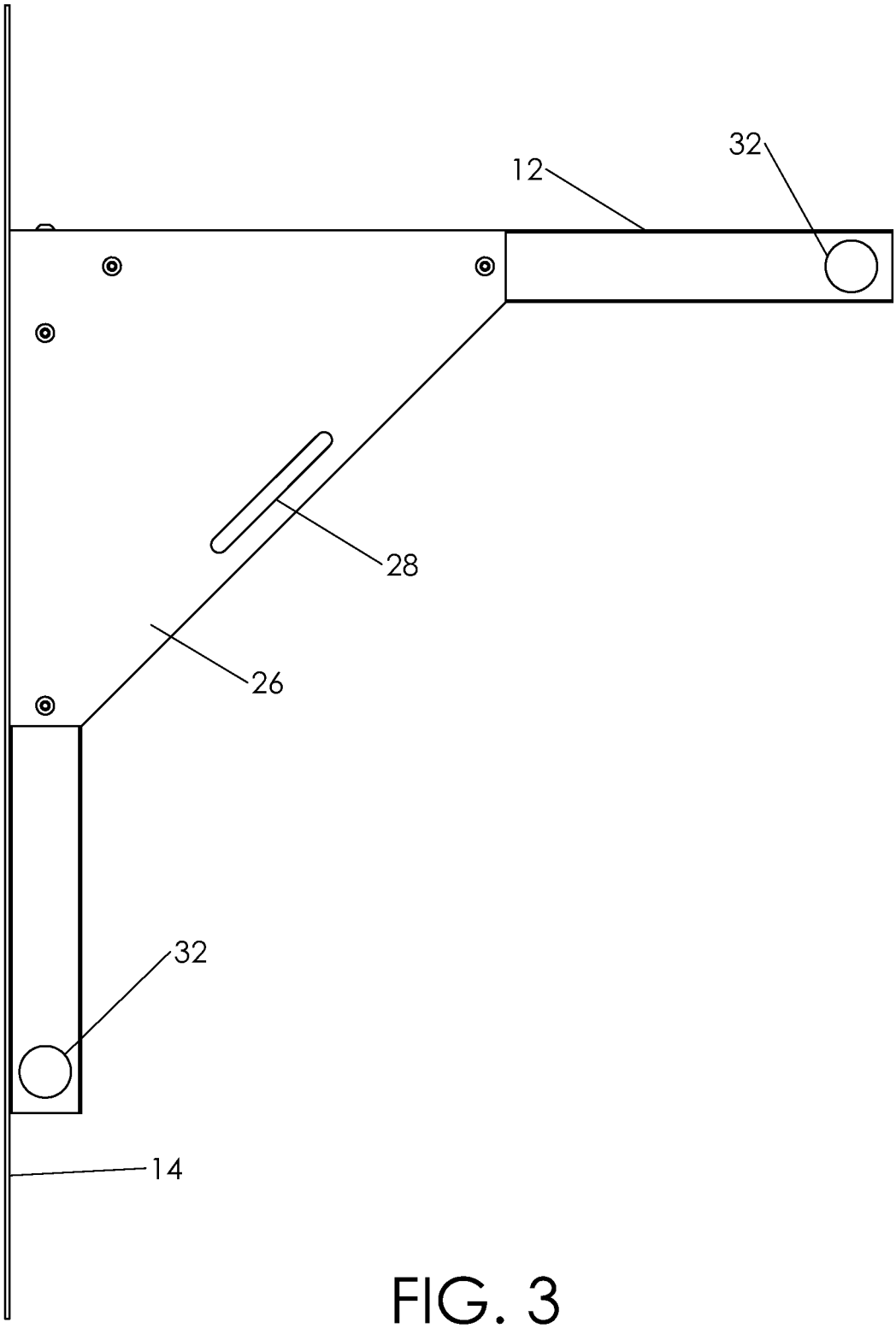
FIG. 3 is a side view of an embodiment of the bracket of the tethered resistance swim training apparatus attached to a wall.
Figure 4:
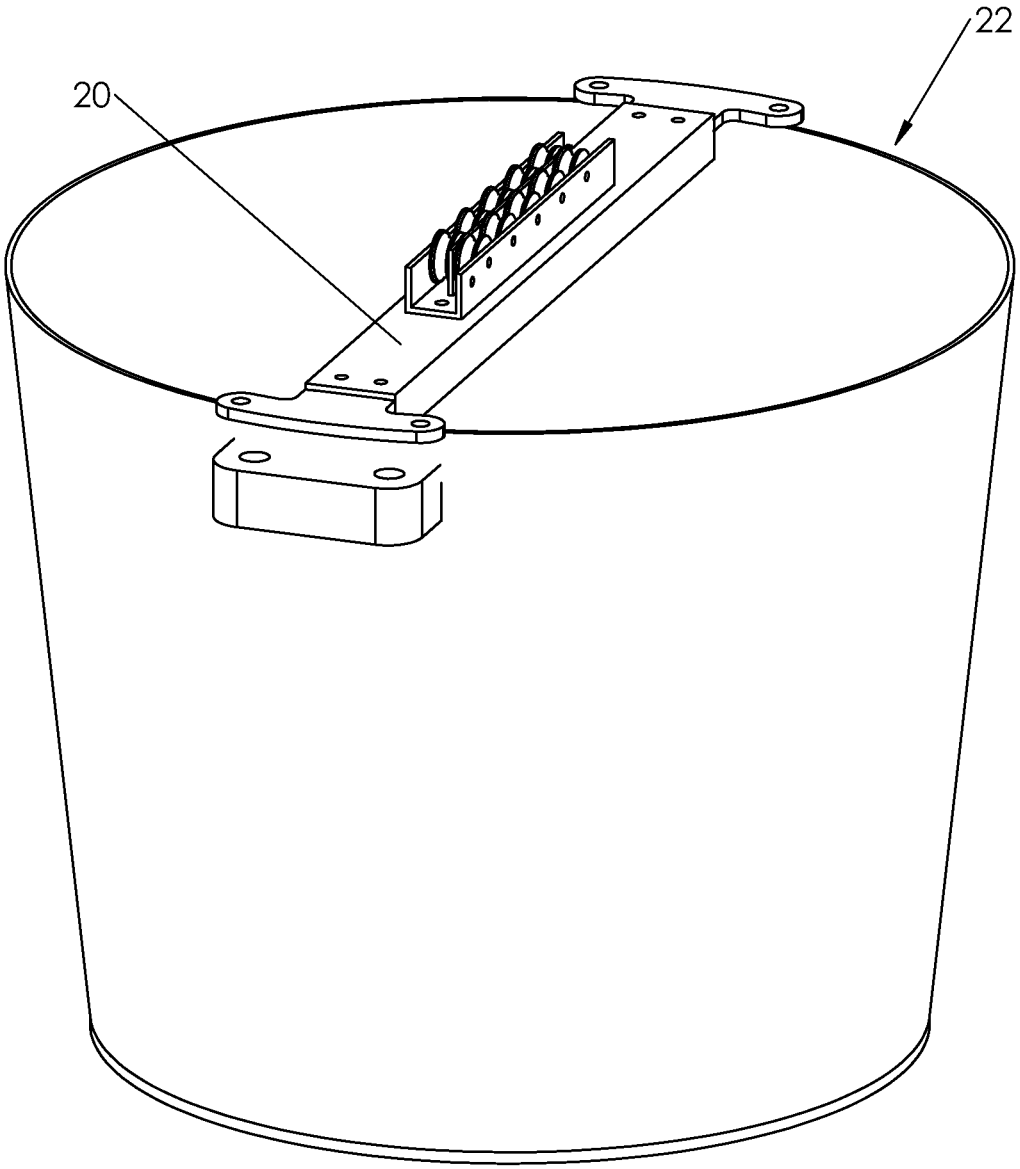
FIG. 4 is an isometric view of an embodiment of the bucket of the tethered resistance swim training apparatus.

Prior to proceeding with the more detailed description of the present invention it should be noted that, for the sake of clarity, identical components which have identical functions have been designated by identical reference numerals throughout the several views illustrated in the drawings.

Referring generally to FIGS. 1-6, in particular to FIGS. 1-4, in a first aspect the present invention provides an apparatus, generally designated 10, including L-shaped bracket 12 mounted to wall 14. Bracket 12 includes top pulleys 16 with cord 18 passing through both top pulley 16 and bottom pulleys 20 which are attached to bucket 22. The free end 24 of cord 18 is attached via a fastener (not show) to a swimmer (not shown) in a swimming pool (not shown) so that bucket 22 moves against gravity to provide resistance to pulling at free end 24 of cord 18. The bracket 12 may further include a gusset plate 26 that includes an elongated opening 28 for attaching additional elastic elements to modify the resistance training Referring more particularly to FIG. 3, the bracket 12 may further include a circular opening 32 in the bracket 12 to allow installation of a pullup bar (not shown) or other attachments between multiple apparatus 10.

Figure 5:
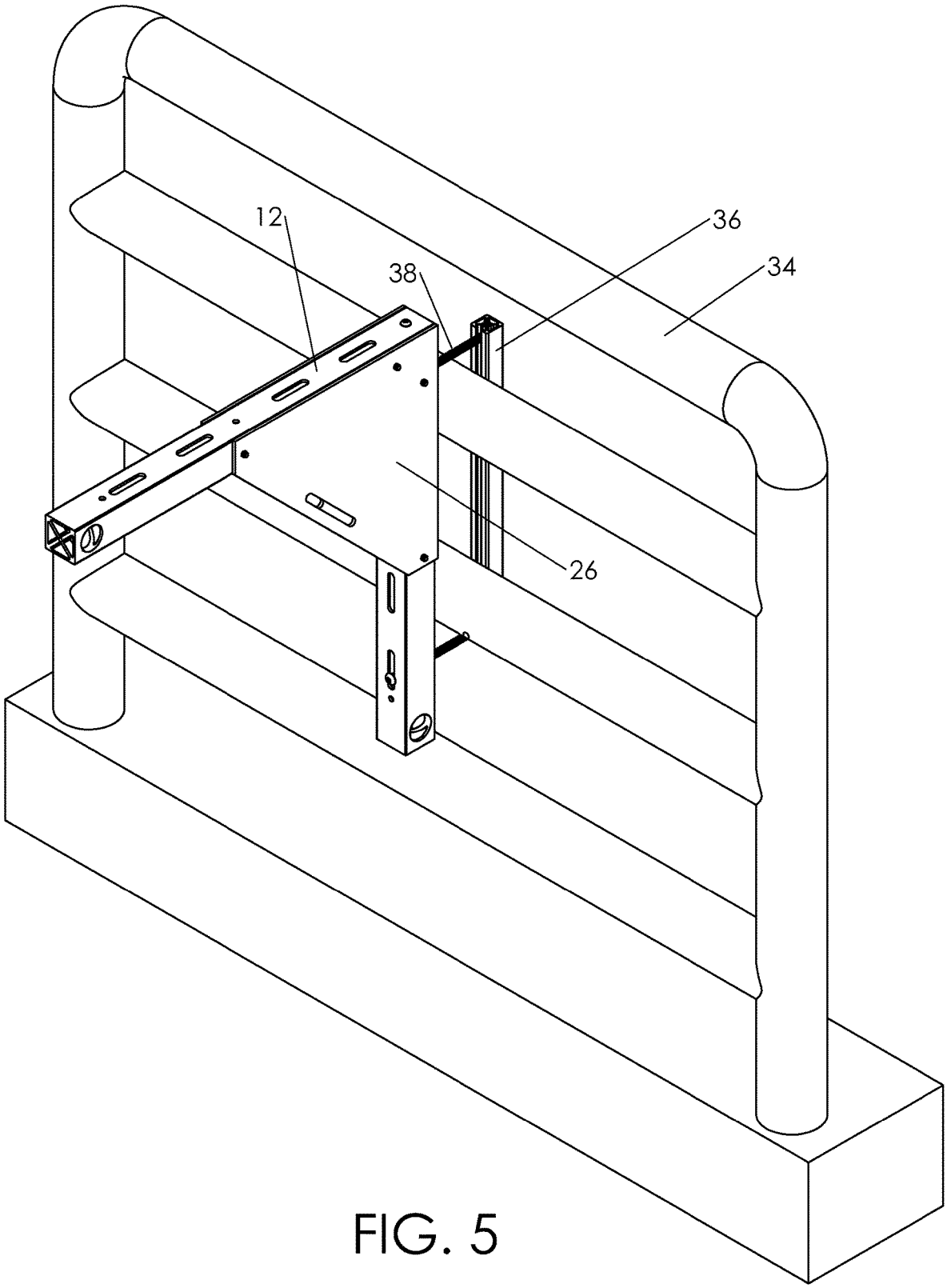
FIG. 5 is an isometric view of an embodiment of the bracket of the tethered resistance swim training apparatus attached to a metal tube pedestrian railing.

Referring to FIG. 5, the apparatus 10 may alternatively be mounted to a typical pedestrian railing 34, which are found in the stands of most pool decks, via the use of extruded aluminum bar 36 and bolts 38 configured to clamp onto pedestrian railing 34.

Figure 6:
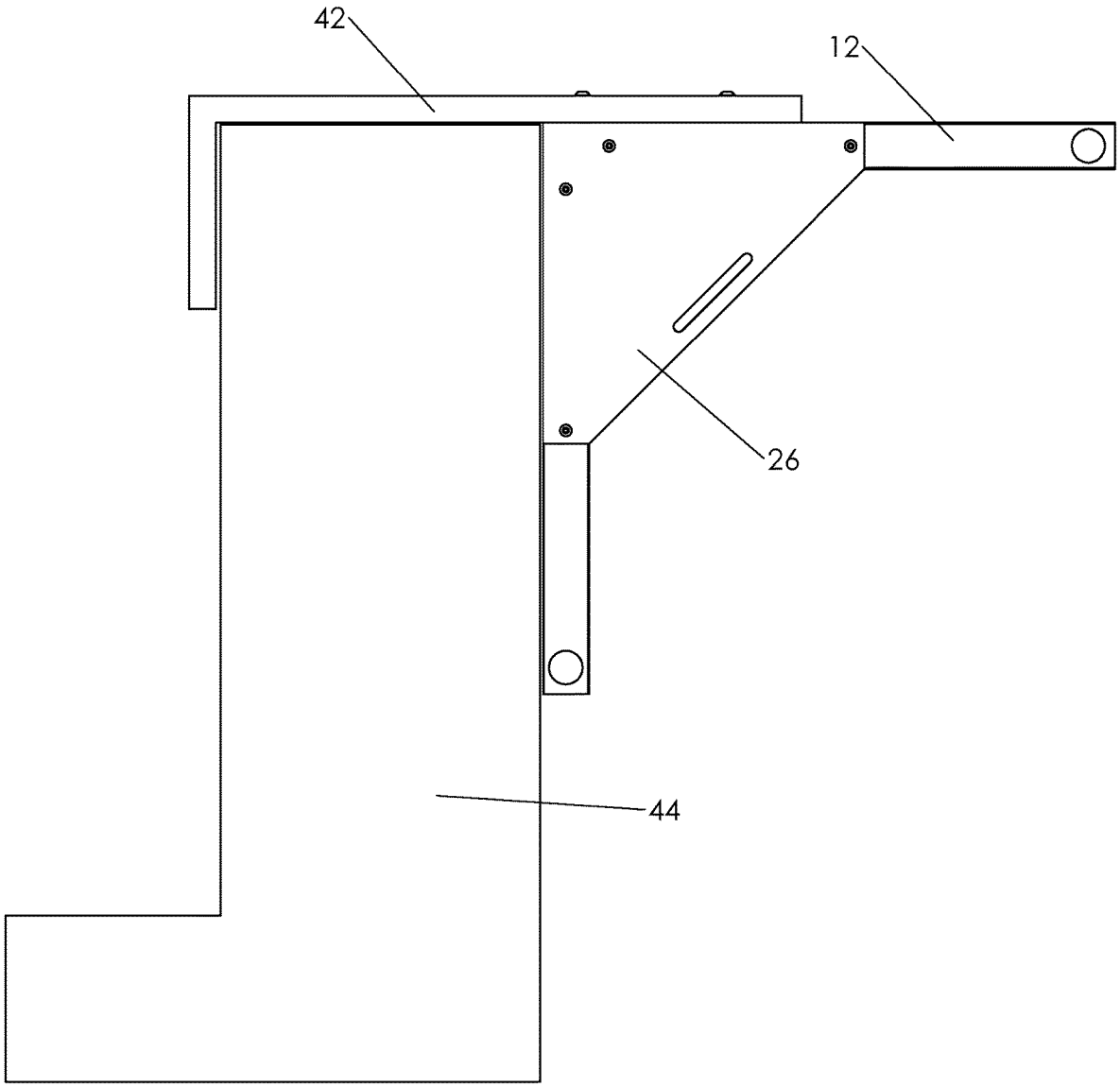
FIG. 6 a side view of an embodiment of the bracket of the tethered resistance swim training apparatus attached to a block pedestrian railing.

Referring to FIG. 6, the apparatus 10 may alternatively be mounted to a block, brick, metal, or glass pedestrian railing 44, which are found in the stands of many pool decks, via the use of L shaped extruded aluminum bar 42 configured to adjustably clamp onto the block, brick, metal, or glass pedestrian railing 44.

While a presently preferred embodiment of the present invention has been described in detail above, it should be understood that various other adaptations and/or modifications of the invention can be made by those persons who are particularly skilled in the art without departing from either the spirit of the invention or the scope of the appended claims.

The invention claimed is:

1. An aquatic exercise apparatus for applying a resistive force to an exercising swimmer, the aquatic exercise apparatus comprising:

a bracket mounted to a vertically oriented surface located above a pool of water;

a container;

an operational assembly comprising at least one upper pulley attached to the bracket and at least one lower pulley attached to the container, a cord passing through the at least one upper pulley and the at least one lower pulley, and a fastener configured to attach to an exercising swimmer, wherein the fastener is attached to a free end of the cord;

wherein pulling the free end of the cord moves the container upward against gravity; and wherein the aquatic exercise apparatus further comprises a plate attached to the bracket, wherein the plate defines an elongated opening configured to receive a second at least one elastic cord that is attached to the fastener.

2. The aquatic exercise apparatus of claim 1 wherein the bracket is L-shaped.

3. The aquatic exercise apparatus of claim 1 wherein the bracket is L-shaped, and is mounted to the vertically oriented surface via an adjustable clamp.

4. The aquatic exercise apparatus of claim 1 wherein the bracket defines a circular opening at a distal end of the bracket, said circular opening being configured to receive a pullup bar.

5. An aquatic exercise apparatus for applying a resistive force to an exercising swimmer, the aquatic exercise apparatus comprising:

an L-shaped bracket mounted to an object located above a pool of water, wherein the L-shaped bracket is mounted to the object via an adjustable clamp;

a container configured to hold a liquid substance or a solid substance;

an operational assembly comprising at least one upper pulley attached to the L-shaped bracket and at least one lower pulley attached to the container, a cord passing through the at least one upper pulley and the at least one lower pulley, and a fastener configured to attach to an exercising swimmer, wherein the fastener is attached to a free end of the cord;

wherein pulling the free end of the cord moves the container upward against gravity; and wherein the container is located above the pool of water.

6. The aquatic exercise apparatus of claim 5 wherein the L-shaped bracket defines a circular opening at a distal end of the L-shaped bracket, said circular opening being configured to receive a pullup bar.

7. An aquatic exercise apparatus for applying a resistive force to an exercising swimmer, the aquatic exercise apparatus comprising:

a bracket mounted to a vertically oriented surface located above a pool of water;

a container;

an operational assembly comprising at least one upper pulley attached to the bracket and at least one lower pulley attached to the container, a cord passing through the at least one upper pulley and the at least one lower pulley, and a fastener configured to attach to an exercising swimmer, wherein the fastener is attached to a free end of the cord;

wherein pulling the free end of the cord moves the container upward against gravity; and wherein the bracket defines a circular opening at a distal end of the bracket, said circular opening being configured to receive a pullup bar.

* * * * *